United States Patent [19]

Matlock

[11] 4,109,761

[45] Aug. 29, 1978

[54] PORTABLE CLIMBING DEVICE

[76] Inventor: Selden W. Matlock, 3312 Breaux Dr., Lousiville, Ky. 40220

[21] Appl. No.: 637,573

[22] Filed: Dec. 4, 1975

[51] Int. Cl.[2] ..... E06C 7/08

[52] U.S. Cl. ..... 182/92

[58] Field of Search ..... 182/92; 248/231, 246, 248/221

[56] References Cited

U.S. PATENT DOCUMENTS

| | | | |
|---|---|---|---|
| 527,763 | 10/1894 | Berg | 248/221 F |
| 557,955 | 4/1896 | Boyer | 248/246 |
| 985,079 | 2/1911 | Venard | 248/231 |
| 2,097,562 | 11/1937 | Day | 182/92 |
| 2,241,695 | 5/1941 | Barton | 248/231 |
| 3,298,459 | 1/1967 | Bergsten | 182/92 |

*Primary Examiner*—Reinaldo P. Machado
*Attorney, Agent, or Firm*—Craig & Antonelli

[57] ABSTRACT

A portable climbing device for facilitating the climbing of a tree is made of an L-shaped bracket and a chain for securing the L-shaped bracket to the tree. At one of the ends of the L-shaped bracket there is a curved camming surface for bearing against the tree and the chain after being wrapped around the tree is attached to this end so that the L-shaped bracket can be moved between a first position in which the chain is loosely wrapped around the tree to a second position in which the chain is tightly wrapped around the tree.

25 Claims, 6 Drawing Figures

FIG. 4.
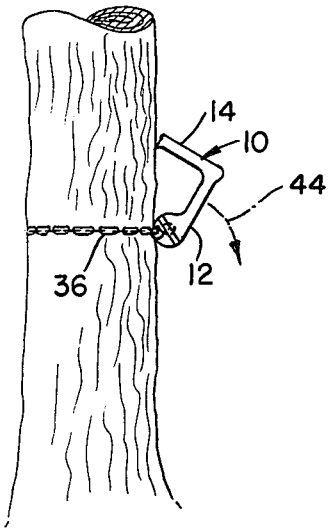
FIG. 5.
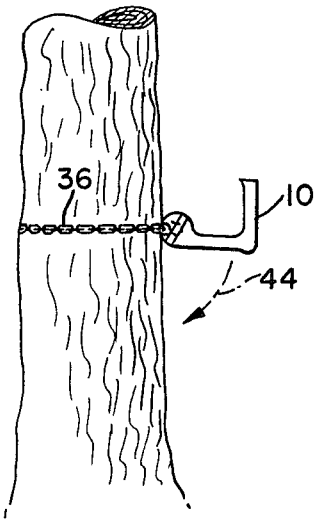
FIG. 6.
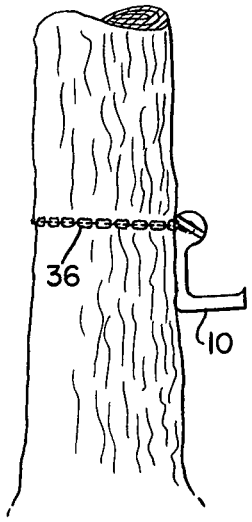
FIG. 2.
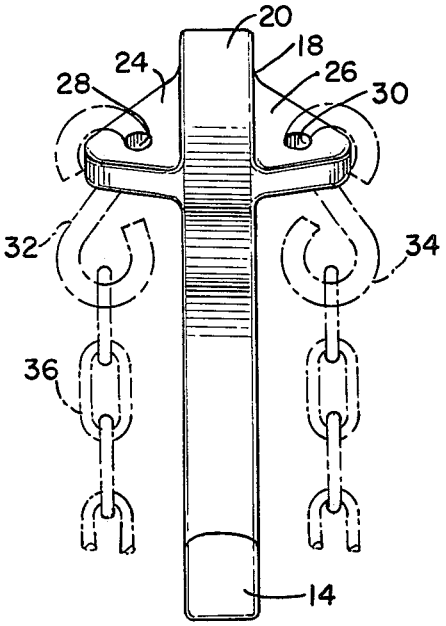
FIG. 1.
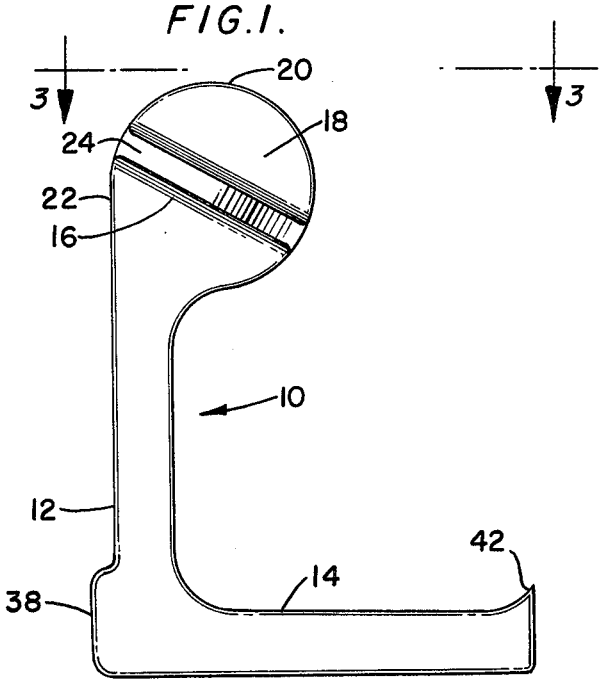
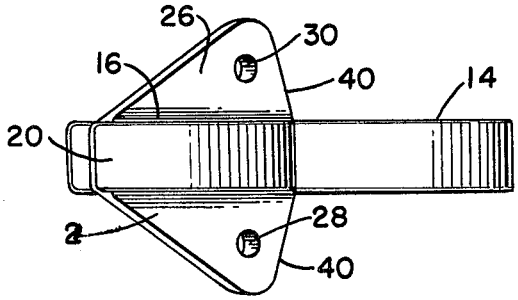
FIG. 3.

PORTABLE CLIMBING DEVICE

BACKGROUND OF THE INVENTION

The present invention relates to a portable climbing device for use in climbing upright structures, such as trees, telephone poles, chimneys and the like and in particular to a portable tree climbing device which has a rugged, but lightweight construction.

Portable climbing devices such as portable steps, portable ladders and the like, for facilitating the climbing of trees, poles, chimneys and the like are known as shown, for example, in U.S. Pat. No. 3,598,201 and U.S. Pat. No. 3,283,852. Such devices are often made-up from many parts and include a tree-engaging portion and a foot-receiving portion and a flexible band such as a chain belt or the like for securing the device to the tree, pole or chimney to be climbed.

Although these known climbing devices can facilitate the climbing of a tree, pole or the like, many devices have a rather complex construction which may require adjustment and which are subject to wear. Also, some devices such as the one shown in U.S. Pat. No. 3,598,201 include sharp projections or the like which are provided to penetrate the surface of the tree or pole being climbed. Such devices may permanently damage the tree and hence are objectionable from an environmental standpoint. Moreover, in many uses, the climbing device must be transported by the person using the device on foot to remote locations. In such cases, climbing devices with a complex construction are often disadvantageous because the devices may be heavy as well as cumbersome and are therefore difficult to carry over long distances, especially over rugged terrain.

Accordingly, it is an object of the present invention to provide a climbing device for facilitating the climbing of vertical structures, such as trees, poles, chimneys and the like, which is of simple and rugged construction, which is lightweight and which requires little or no adjustment.

In addition, it is a further object of the present invention to provide a climbing device which is free of projections for penetrating the surface of the tree or pole to be climbed and hence can be used for climbing a tree with little or no adverse effect on the tree.

SUMMARY OF THE INVENTION

These and other objects are accomplished in accordance with the present invention by providing a novel climbing device consisting of a unitary bracket, generally L-shaped, and flexible structure-engaging means, such as a chain securing the bracket to the vertical structure to be climbed. In general, the bracket includes a step or foot-supporting portion and a structure-engaging portion which extends perpendicular to the step portion.

At the end of the structure-engaging portion there is a curved camming surface for bearing against the vertical structure and the chain is attached to this end of the L-shaped bracket in such a way that the L-shaped bracket when the camming surface engages the tree, can be moved between a first position in which the chain is loosely wrapped around the tree to a second, in-use, position in which the chain is tightly wrapped around the tree. The surfaces of the structure-engaging portion of the L-shaped bracket which come into contact with the tree provide a wide, continuous contact area so that penetration of the bark of the tree is prevented.

Advantageously, because the climbing device of this invention is adapted to be mounted to an in-use position by a camming action which draws the chain and bracket tightly around a tree to be climbed, the climbing device can be securely mounted in position and be used without requiring the use of a sharp projection that penetrates the surface of the tree.

More particularly, the climbing device of this invention comprises a rigid L-shaped bracket and a flexible structure-engaging elongated means having at least one end releasably secured to the bracket. The end of the structure-engaging portion of the bracket remote from the foot-supporting portion has a positioning head defining a circular camming surface for engaging the structure and means for attaching the bracket to the flexible structure-engaging means. The camming surface is constructed to increase the tension exerted by the bracket on the flexible means when the flexible means is wrapped around the structure and connected to the attaching means and the bracket is moved from a first position in which the camming surface is in contact with the structure to be climbed to a second position in which the structure-engaging portion engages or contacts the vertical structure. In use on trees, for example, the foot-supporting portion is moved from the first position in which the foot-supporting portion is vertically above the structure-engaging portion to an in-use position in which the foot-supporting portion is vertically below the structure-engaging portion.

BRIEF DESCRIPTION OF THE DRAWINGS

The present invention may be more easily understood by reference to the following drawings wherein:

FIG. 1 is an elevational view of the L-shaped bracket of the climbing device of the present invention;

FIG. 2 is a view taken on line 2—2 of FIG. 1 and shows the L-shaped bracket of FIG. 1 in combination with S-shaped hooks and an associated chain for mounting the L-shaped bracket on a tree or the like;

FIG. 3 is a top view of the L-shaped bracket illustrated in FIG. 1 and is taken on line 3—3 of FIG. 1; and FIGS. 4 to 6 are illustrations showing how the inventive climbing device is attached to and mounted on a tree to facilitate the climbing thereof.

DETAILED DESCRIPTION

Referring to FIGS. 1 to 3 of the drawings, the L-shaped bracket 10 of the climbing device includes a structure-engaging portion 12 and a foot-supporting portion 14 extending from the structure-engaging portion at right angles thereto. The bracket, as shown, is a unitary member molded or cast from a lightweight metal such as aluminum. End 16 of structure-engaging portion 12 is provided with an enlarged positioning head 18. As shown in FIG. 1, the positioning head 18 defines a continuous camming surface 20 which is substantially circular in configuration; camming surface 20 tangentially mating with the outer surface 22 of structure-engaging portion 12.

For securing the bracket 10 to a flexible, structure-engaging means, the bracket is provided with two flanges 24 and 26. As shown in FIGS. 2 and 3, flanges 24 and 26 have holes 28 and 30, respectively, which are adapted to receive S-shaped hooks 32 and 34. As shown in FIG. 2, S-shaped hooks 32 and 34 together releasably secure L-shaped bracket 10 to chain 36, used for securing the L-shaped bracket 10 to the trunk of a tree or pole to be climbed. Advantageously, the outer periphery of structure-engaging portion 12 adjacent the intersection with foot-supporting portion 14 is provided with a flat projection 38 for engaging the surface of the tree or the like to be climbed, and the end 40 of the foot-supporting portion 14 is provided with a guiding and retaining lip 42 for guiding the foot of a climber into position on portion 14 and for preventing the foot of a climber from slipping off.

FIGS. 4 to 6 illustrate how the inventive climbing device is attached to a vertical structure such as a tree, and moved to an in-use position. As shown in FIG. 4, L-shaped bracket 10 is initially placed adjacent to a tree with foot-supporting portion 14 positioned above structure-engaging portion 12. In this position, chain 36 is wrapped around the tree and secured by S-shaped hooks 32 and 34 to flanges 24 and 26 as tightly as possible. Then, L-shaped bracket 10 is rotated in the direction of arrow 44 from the position shown in FIG. 4 through the position shown in FIG. 5 and to the position shown in FIG. 6. Due to the positioning of holes 28 and 30 in flanges 24 and 26, and the configuration of camming surface 20, this rotating action causes chain 36 to be very tightly drawn around the trunk of the tree. Because chain 36 is so tightly wrapped around the tree or pole, L-shaped bracket 10 will not be moved downwardly to any significant degree even when a comparatively large force is applied by the climber to foot-supporting portion 12.

Once the L-shaped bracket is in the position shown in FIG. 6, the climbing device is ready for use. The climber then can exert all his weight on portion 14 of L-shaped bracket 10 and by this means elevate himself upwardly along the trunk of a tree or pole to be climbed. A plurality of climbing devices in accordance with the present invention may be placed at successive vertical locations along a tree or pole when the climber desires to climb further up the tree or pole.

From the foregoing, it can be seen that one unique feature of the present invention is that no sharp projections are needed to securely attach the climbing device to the tree or pole. This is due to the fact that considerable tension is developed in chain 36 during movement of L-shaped bracket 10 from the position shown in FIG. 4 to the position shown in FIG. 6 by the outward movement caused by the configuration of camming surface 20 and the positioning of holes 28 and 30 in flanges 24 and 26. Also, it should be appreciated that camming surface 20 and holes 28 and 30 are preferably arranged as shown in the drawings, to ensure that L-shaped bracket 10 is locked in place by the tension of chain 36 when the inventive climbing device is in an in-use position as shown in FIG. 6. It will be appreciated that this can be accomplished by positioning flanges 24 and 26 and holes 28 and 30 so that the maximum tension in chain 36 is developed before L-shaped bracket 10 reaches the final in-use position as shown in FIG. 6. In general, the flanges 24 and 26 are placed at an angle less than 90° from the longitudinal axis of the portion 12. Preferably, this angle is 45°. The holes 28 and 30 are positioned on the flanges near the edges 40 so that the movement of the L-shaped bracket from the position shown in FIG. 4 to that shown in FIG. 6 will cause a take-up in the length of the chain of from about 1–2 inches.

Although the drawings illustrate camming surface 20 to be substantially circular in configuration, camming surfaces of other configurations which provide the same take-up action when in combination with a chain or other flexible means can be employed. Furthermore, although the drawings illustrate chain 36 being attached to the positioning head 18 of L-shaped bracket 10 by means of S-shaped hooks 32 and 34 and flanges 24 and 26, it should be appreciated that other chain-attaching means can be used. For example, cylindrical projections emanating from the head 18 at suitable locations might be employed.

Furthermore, it should be appreciated that flexible elongated structure-engaging means other than a chain, can be used. For example, cables, steel bands or the like so long as this means is made of a material which will not stretch when placed under this required tension.

Also, it should be appreciated that the L-shaped bracket of the inventive climbing device can be made from any solid, load-bearing material. Of course, since the inventive climbing device may be carried by users for long distances, it is preferable to form the L-shaped bracket from lightweight materials, such as aluminum, fiberglass or reinforced plastics or the like. Also, it is preferable that the L-shaped bracket be formed as an integral casting since this simplifies the manufacture thereof and also provides a rugged construction which requires no maintenance and little or no adjustments. Also, it is preferred that the cross-section of the bracket provide a flat contact surface for engaging the surface of the tree to be climbed. With this configuration a more stable step is provided for the climber. The preferred cross-section is rectangular as shown.

Although only a single embodiment of the present invention has been described above, it should be appreciated that many modifications can be made without departing from the spirit and scope of the invention. All such modifications are intended to be included within the scope of the present invention, which is to be limited only by the following claims:

What is claimed is:

1. A climbing device for facilitating the climbing of a vertical structure, such as a tree, pole or the like, comprising:

a bracket, and flexible, elongated structure-engaging means for wrapping around said structure and for securing said bracket to said vertical structure, said bracket having a structure-engaging portion, a foot-supporting portion extending from one end of said structure-engaging portion, a camming surface for engaging said structure located at the other end of said structure-engaging portion, and means for releasably attaching said bracket to said flexible means, said camming surface and said attaching means operatively cooperating to increase the tension exerted by said bracket on said flexible means when said flexible means is wrapped around said structure and connected to said attaching means and said bracket is moved from a first position in which the camming surface engages said structure to a second position in which said structure-engaging portion engages said vertical structure, said attaching means including at least one positioning flange arranged at opposite lateral sides of said camming surface, each of said flanges extending laterally outwardly from said camming surface and being arranged at a predetermined angle with respect to a longitudinal axis of said structure-engaging portion, means for securing free ends of said flexible means to a respective flange and means being provided at each of the flanges for accomodating said securing means.

2. The device of claim 1, wherein said foot-supporting portion is substantially horizontal in said second position.

3. The device of claim 2, wherein all surfaces of said bracket coming into contact with said structure as said bracket is moved from said first position to said second position are free of sharp projections capable of piercing the surface of said vertical structure.

4. The device of claim 3, wherein said camming surface is continuous.

5. The device of claim 4, wherein the camming surface includes a curved portion.

6. The device of claim 5, wherein said camming surface is a continuous curve, said camming surface tangentially meeting with a surface of said structure-engaging portion.

7. The device of claim 6, wherein said structure-engaging portion has a flat projection for engaging said structure when said bracket is in said second position, said projection being adjacent to the intersection of said structure-engaging portion with said foot-supporting portion.

8. The device of claim 4, wherein said bracket is an integral structure.

9. The device of claim 8, wherein said bracket is a casting of a lightweight metal.

10. The device of claim 9, wherein said flexible, means is a chain.

11. The device of claim 3, wherein said bracket is an L-shaped bracket.

12. The device of claim 1, wherein said bracket is an L-shaped bracket.

13. The device of claim 1, wherein said flanges are integrally formed with said camming surface.

14. The device of claim 1, wherein said structure-engaging portion includes a flat projection adjacent an intersection of said structure-engaging portion and said foot-supporting portion.

15. An L-shaped bracket for use in facilitating the climbing of a structure such as a tree, pole or the like, said L-shaped bracket comprising an integral member having a structure-engaging portion, a foot-supporting portion extending perpendicularly from one end of said structure engaging portion, a camming surface for engaging said structure located at the other end of said structure-engaging portion, and means for releasably attaching said bracket to a flexible means, said camming surface and said attaching means operatively cooperating to increase the tension exerted by said bracket on a flexible means when a flexible means is wrapped around said structure and connected to said attaching means and said bracket is moved from a first position in which the camming surface engages said structure to a second position in which said structure-engaging portion engages said vertical structure, said attaching means including at least one positioning flange arranged at opposite lateral sides of said camming surface, each of said flanges extending laterally outwardly from said camming surface and being arranged at a predetermined angle with respect to a longitudinal axis of said structure-engaging portion, means for securing free ends of said flexible means to a respective flange and means at each of the flanges for accomodating said securing means.

16. The L-shaped bracket of claim 15, wherein all surfaces of said L-shaped bracket coming into contact with said vertical structure when said bracket is moved from said first position to said second position are free of sharp projections capable of piercing the surface of said static structure.

17. The L-shaped bracket of claim 16, wherein said camming surface is continuous.

18. The L-shaped bracket of claim 17, wherein said L-shaped bracket is a casting of a lightweight metal.

19. The device of claim 13, wherein said predetermined angle is less than 90°.

20. The device of claim 13, wherein said predetermined angle is at least equal to 45°.

21. The device of claim 1, wherein said predetermined angle is less than 90°.

22. The device of claim 13, wherein said flanges are integrally formed with said camming surface.

23. The device of claim 13, wherein said predetermined angle is less than 90°.

24. The device of claim 13, wherein said predetermined angle is at least equal to 45°.

25. The device of claim 13, wherein said structure-engaging portion includes a flat projection adjacent an intersection of said structure-engaging portion and said foot-supporting portion.

* * * * *